United States Patent [19]

Koslow et al.

[11] Patent Number: 4,829,771

[45] Date of Patent: May 16, 1989

[54] THERMOELECTRIC COOLING DEVICE

[75] Inventors: Evan E. Koslow, Westport, Conn.; James R. Wiggins, Gaithersburg, Md.

[73] Assignee: Koslow Technologies Corporation, Stratford, Conn.

[21] Appl. No.: 172,469

[22] Filed: Mar. 24, 1988

[51] Int. Cl.[4] ..... F25B 21/02

[52] U.S. Cl. ..... 62/3.64

[58] Field of Search ..... 62/3

[56] References Cited

U.S. PATENT DOCUMENTS

| | | | |
|---|---|---|---|
| 2,886,618 | 5/1959 | Goldsmid | 62/3 X |
| 3,552,133 | 1/1971 | Lukomsky | 62/3 |
| 4,281,516 | 8/1981 | Berthet et al. | 62/3 |

*Primary Examiner*—Lloyd L. King

*Attorney, Agent, or Firm*—Parmelee, Bollinger & Bramblett

[57] ABSTRACT

This invention is a device for efficiently cooling a fluid, such as drinking water. It comprises a stack of thermoelectric cooling modules which are oriented with the hot sides of adjacent modules facing each other, and with the cold sides also facing each other. Positioned between each pair of modules is an elastomeric spacer which forms a leakproof seal with each module. The spacer defines a fluid channel between the sides of the adjacent modules and also has a fluid inlet and a fluid outlet. The fluid to be cooled is circulated through those spacers which are positioned between the cold sides of the thermoelectric modules. A coolant is circulated through those spacers which are positioned between the hot sides of the thermoelectric modules.

20 Claims, 3 Drawing Sheets

THERMOELECTRIC COOLING DEVICE

TECHNICAL FIELD

This invention pertains to thermoelectric cooling. More particularly, it pertains to an efficient thermoelectric cooling device formed from a plurality of thermoelectric modules combined with a plurality of novel spacing elements.

BACKGROUND ART

Thermoelectric cooling is a well-known phenomenon. It utilizes the so-called Peltier thermoelectric effect. When an electrical current flows across the junction of two dissimilar metals, it gives rise to an absorption or liberation of heat. If the current flows in the same direction as the current at the hot junction of a thermoelectric circuit of the two metals, heat is absorbed. If the current flows in the same direction as the current at the cold junction of the thermoelectric circuit, heat is liberated.

As a result of the utility of the Peltier effect, modules making use of the effect are readily commercially available, as will be further explained below. A number of devices have been proposed which utilize the effect including, inter alia, the disclosures of the following U.S. Pat Nos.: 3,080,723 of Price, 3,085,405 of Frantti; 3,154,926 of Hirschhorn; 4,237,877 of Boehler; 4,470,263 of Lehovec et al.; 4,483,021 of McCall; and 4,551,857 of Galvin.

Although the efficiency of Peltier effect modules is relatively low, they are uniquely suited to certain applications due to their lack of moving parts. Accordingly, it is an object of the present invention to provide a thermoelectric cooling device which maximizes cooling efficiency in a rugged, highly versatile, configuration. Other objects, features, and advantages will become apparent from the following description and appended claims.

DISCLOSURE OF INVENTION

The invention is a novel construction of a plurality of thermoelectric cooling modules arranged in a stack and alternating with a plurality of spacer elements. The cooling modules are arranged such that the hot surfaces of adjacent modules face one another, as do the cold surfaces. The spacer between each pair of facing surfaces includes a fluid passage in heat transfer relationship with the surfaces. The spacer may be formed of an elastomeric material so that it is self-gasketing and leakproof. A fluid to be cooled is passed through those spacers separating the cold surfaces. The waste heat is removed by a fluid passed through those spacers separating the hot surfaces.

BRIEF DESCRIPTION OF DRAWINGS

The invention will be described by way of example with reference to the following drawings.

BEST MODE FOR CARRYING OUT THE INVENTION

Figure 1:
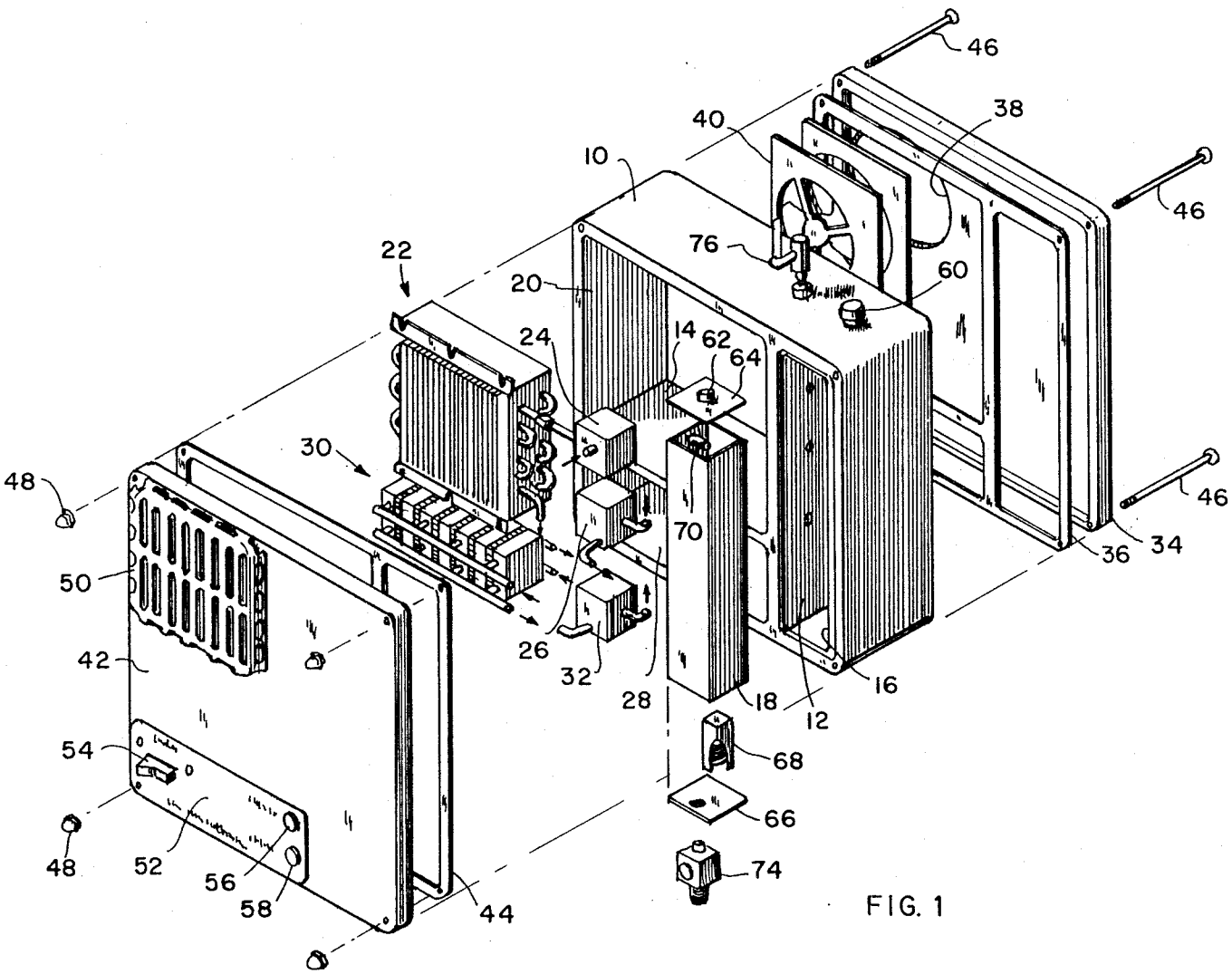
FIG. 1 is an exploded perspective view of a water cooler employing the device of this invention.

With particular reference to FIG. 1, there is illustrated a water cooler (and heater) which makes use of the cooling module of the invention. One potential use of such a cooler would be as an adjunct to a motorized vehicle operating in a desert environment in order to provide cool drinking water or other beverage. A device of this type could also be mounted on a tractor or in a motor home. In fact, its utility is limited only by the need for a direct current power source.

The cooler of FIG. 1 comprises a rectangular housing 10 divided by a vertical wall 12 and a horizontal wall 14 into three compartments. The right hand compartment 16, as viewed in FIG. 1, is tall and narrow to receive a polypropylene reservoir 18 and surrounding foam insulation (not shown). The upper compartment 20 formed by the horizontal wall 14 is essentially square and encloses a finned tube heat exchanger assembly 22, a hot water pump 24, and a source pump 26. The lower compartment 28 formed by the horizontal wall 14 is rectangular and encloses a thermoelectric cooling stack 30 and a cold pump 32.

The back of the housing 10 is closed by a back plate 34 and a gasket 36. The back plate 34 includes a circular air exhaust opening 38 within which is housed a motorized fan 40 which extends into the upper compartment 20 to draw air through the finned tube heat exchanger 22.

The front of the housing 10 is closed by a front plate 42 and a gasket 44. The assembled casing comprising the housing 10, the back plate 34, and the front plate 42 is held together by tie bolts 46 and nuts 48. The front plate 42 includes an inlet air grille 50 and carries a control panel 52. Mounted on the control panel 52 is a three-position switch 54 with settings of "Heat", "Off", and "Cool", a "Ready" light 56 and a "Low Voltage" light 58.

Mounted on the top of the housing 10 is a vent cap 60 which communicates with the interior of the reservoir 18 through an opening 62 in the top plate 64 of the reservoir. Also mounted on the top of the housing 10 is a shut-off valve 76 which connects to an external water supply, such as a tank, not shown. Positioned in the bottom of the reservoir 18, by mounting on the reservoir bottom plate 66, is a resistance heater 68. Also contained within the reservoir 18, but near its top, is a level sensor 70. The reservoir also houses a temperature sensor 72, which is not seen in FIG. 1. A pushbutton operated pour valve 74 on the bottom plate of the reservoir 18 permits the contents to be emptied as desired.

Figure 2:
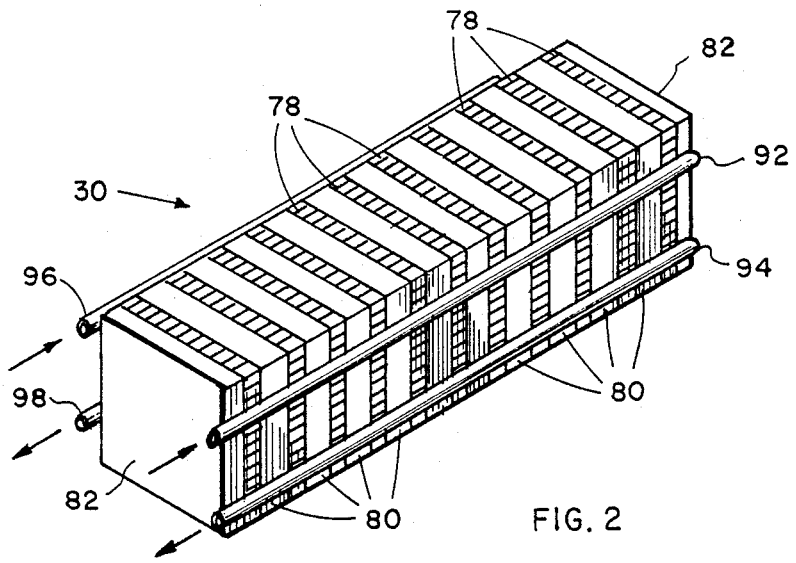
FIG. 2 is a perspective view of the thermoelectric cooling device of the invention.
Figure 3:
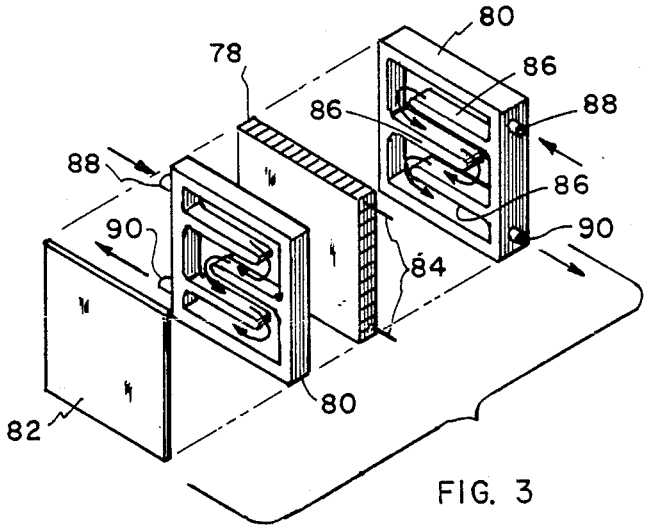
FIG. 3 is an exploded detail illustrating the construction of the device of FIG. 2.

The construction of the thermoelectric cooling stack 30 of this invention can best be seen in FIGS. 2 and 3. It comprises a plurality of rectangular, commercially available thermoelectric cooling modules 78 alternating with spacers 80 and terminating at end plates 82. Each module has a cold surface and a hot surface and a pair of electrical leads 84. They are so arranged in the stack that adjacent modules have their cold surfaces facing and their hot surfaces facing. Thus, each spacer 80 is sandwiched between either two hot or two cold surfaces. Suitable cooling modules are Models CP5-31-06L and CP5-31-10L of Materials Electronic Products Corp. They are described by the manufacturer as being solderable, ceramic insulated, thermoelectric modules. Each module contains 31 couples. The thermoelectric material is a quaternary alloy of bismuth, tellurium, selenium, and antimony with small amounts of dopants, processed to produce an oriented polycrystalline ingot.

The spacers 80 are identical but alternately reversed in the stack 30. They are formed of silicon rubber which acts as a gasket and seals against the thermoelectric modules 78 to prevent fluid leakage. Baffles 86 within each spacer form a serpentine channel which communicates with a fluid inlet 88 and a fluid outlet 90 in one edge of each spacer. As will be apparent, the sides of each channel are formed by the hot or cold surfaces of the adjacent modules to thereby maximize heat transfer to or from the fluid in the channel. This arrangement obviates the necessity of using conventional heat exchanger plates and the problems of obtaining good heat transfer with the modules through the use of applied pressure or thermal grease.

The alternate reversal of the spacers 80 in the stack 30 results in the fluid inlets and outlets of every other spacer being aligned. A water inlet manifold 92 is connected to the inlets 88 of those spacers located between cold surfaces and a water outlet manifold 94 is connected to their outlets 90. Similarly, a coolant inlet manifold 96 is connected to the inlets 88 of those spacers located between hot surfaces and a coolant outlet manifold 98 is connected to their outlets 90. This cooling stack assembly is simple to fabricate and of low cost. After assembly, it is encapsulated in a suitable resin, resulting in a unit which is exceptionally rugged and has stable performance characteristics.

EXAMPLE I

A thermoelectric cooling stack was constructed as above employing four modules, each operating at 4.8 volts×6.7 amps.=32.16 watts, for a total of 128.64 watts. The results of three tests were as follows:

Test #1:
70° F. Ambient Air Temperature
71.2° F. Chilled Water Outlet 95.7° F. Hot Water Outlet
75.0° F. Chilled Water Return 90.9° F. Hot Water Return
121.07 BTU/Hr cooling (35.46 watts).

Test #2:
70° F. Ambient Air Temperature
80.2° F. Chilled Water Outlet 105.2° F. Hot Water Outlet
84.1° F. Chilled Water Return 99.9° F. Hot Water Return
132 BTU/Hr cooling (38.60 watts).

Test #3:
70° F.
81.4° F. Chilled Water Outlet 99.1° F. Hot Water Outlet
87.0° F. Chilled Water Return 94.3° F. Hot Water Return
154.6 BTU/Hr cooling (45.3 watts).

EXAMPLE II

The stack of Example I was scaled up to include 24 modules operating at 772 watts.

Test #1:
726.4 BTU/Hr cooling (212.8 watts).

Test #2:
792.0 BTU/Hr cooling (232.1 watts).

OPERATION

Figure 4:
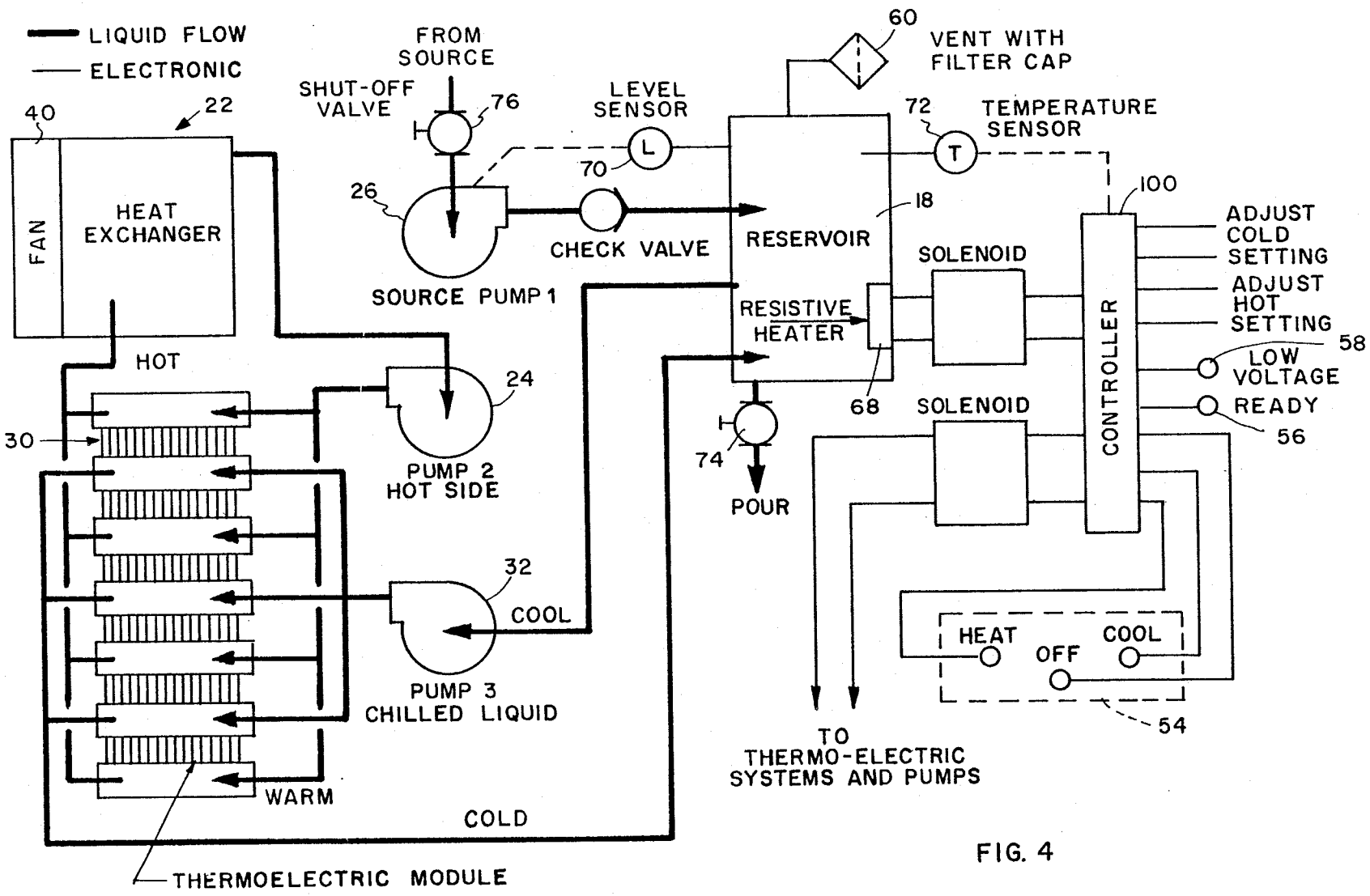
FIG. 4 is a schematic diagram illustrating the operation of the water cooler of FIG. 1.

The operation of a water heating and cooling unit as illustrated in FIGS. 1 and 4, with the thermoelectric cooling stack described above, will now be explained. In the following description, drinking water is dispensed and a 50:50 mixture of ethylene glycol and water serves as the coolant.

To operate the system in the hot mode, the shut off valve 76 is opened and the control switch 54 set to the "HEAT" position. If the available voltage is outside the acceptable nominal range, the low voltage LED 58 will be lit and the system will not actuate. If the measured voltage is within the nominal range and the level sensor 70 detects that the reservoir 18 is not filled, the heater 68 will not actuate. Instead, source pump 26 will start and draw water from an external source into the reservoir 18 which, in one embodiment, has a total volume of 500 ml. When the liquid reaches 400 ml, the level sensor 70 indicates that the reservoir is filled and the resistance heater 68 is energized. This heater has a rating of 65 watts and rapidly heats the water in reservoir 18. When the desired water temperature is reached, the green "Ready" light 56 will light and remain lit for as long as the temperature is maintained. Hot water may be withdrawn through pour valve 74.

When the system is operated in the "Heat" mode, the thermoelectric cooling stack 30 and its associated pumps and equipment are not active. The system operates in a manner similar to a coffee maker. When the temperature of the water reaches the calibration set point, the heater 68 is turned off and the "Ready" LED lights to indicate water can be withdrawn. The heater will continue to actuate whenever the temperature drops below an established minimum set point.

The pour valve 74 is over-sized to allow rapid emptying of the reservoir in less than 4 seconds. If hot water is withdrawn, the level sensor 70 will detect a decline in water level and actuate source pump 26 to add water. The source pump 26 operates at a nominal rate of 1000 ml/min and will fill the reservoir 18 in approximately 25 seconds. The addition of water will cause the temperature sensor 72 to activate the heater 68 to heat the incoming water. "Ready" light 56 will go out until the temperature is in the desired range.

In order to produce cold water, the control switch 54 is set to the "Cool" position. The system will operate in a manner similar to that described for the heating mode. If the applied voltage is below the acceptable range, the unit will not actuate and the low voltage light 58 will be on. If the reservoir 18 is not full, the source pump 26 will be actuated. When the level sensor 70 detects that the reservoir water level is correct, the thermoelectric stack 30 and its associated equipment are energized.

In the cool operating mode, the cold pump 32 circulates water between the reservoir 18 and the thermoelectric stack 30 which includes six thermoelectric modules 78 and the associated spacers 80, as described above. The water being chilled enters the thermoelectric stack 30 from the water inlet manifold 92. Heat from this water is passed by the thermoelectric modules 78 to the spacers 80 which form leak-tight seals on the hot sides of the modules. This arrangement is exceptionally efficient and allows an enormous amount of heat to be moved in a small, lightweight assembly. The chilled water produced within the thermoelectric stack 30 is continuously circulated from the water outlet manifold 94 back to the reservoir 18. The hot coolant produced within the thermoelectric stack 30 is collected in the spacers 80 which are coupled to the hot sides of the modules 78. This hot coolant is circulated by the hot side pump 24 from the coolant outlet manifold 98 to the finned tube heat exchanger 22. The axial fan 40 draws 40–50 SCFM of ambient air through the heat exchanger 22 to cool the coolant, which is then returned to the thermoelectric stack through coolant inlet manifold 96.

When the temperature sensor 72 mounted in the reservoir 18 detects that the water has been chilled to the correct temperature, the controller turns off the hot side pump 24, the cold pump 32, the fan 40, and the thermoelectric stack 30. The unit will maintain the nominal temperature of the water held within the reservoir 18 by again actuating whenever the temperature rises above an established set point. When the nominal temperature is reached, the Ready light 56 goes on. When water is discharged from the reservoir 18, the sensors 70, 72 detect the changes in water level and temperature and the filling and cooling cycles resume.

To prevent mixing of incoming water during the withdrawal of water from the reservoir 18, the pour valve 74 is designed as a solenoid push-button valve. It simultaneously inactivates source pump 26 to prevent unconditioned water from entering the reservoir 18. Source pump 26 automatically refills the reservoir 18 when the pour valve 74 is released.

It is believed that the many advantages of this invention will now be apparent to those skilled in the art. It will also be apparent that a number of variations and modifications may be made therein without departing from its spirit and scope. Accordingly, the foregoing description is to be construed as illustrative only. This invention is limited only by the scope of the following claims.

We claim:

1. A thermoelectric cooling stack which comprises:

a plurality of thermoelectric modules, each having a relatively coolable surface and a relatively heatable surface interconnected by thermoelectric junction forming means, said modules being arranged such that the heatable surfaces of adjacent modules face each other and the coolable surfaces of adjacent modules face each other;

means for electrically energizing said thermoelectric junctions to activate said surfaces to their hot and cold relative temperatures;

a plurality of spacers, each spacer being positioned between, and sealed against, either of two facing hot surfaces or two facing cold surfaces, each of said spacers defining a fluid flow passage further defined by said facing surfaces;

means for passing a fluid to be cooled through those passages of said spacers further defined by said facing cold surfaces; and means for passing a fluid to be heated through those passages of said spacers further defined by said facing hot surfaces.

2. The stack of claim 1 wherein at least one of said fluids is liquid.

3. The stack of claim 1 wherein each of said spacers includes baffles to define its fluid flow passage in serpentine form.

4. The stack of claim 1 further comprising:

means for receiving the fluid heated by said stack, removing at least a portion of the heat therefrom, and recirculating the heated fluid to said stack.

5. The stack of claim 4 wherein said heat removing means comprises a heat exchanger for dissipating said heat to ambient atmosphere.

6. The stack of claim 1 wherein said spacers are elastomeric and in intimate sealing engagement with their respective facing surfaces.

7. The stack of claim 6 wherein each of said spacers includes baffles to define its fluid flow passage in serpentine form.

8. The stack of claim 7 wherein at least one of said fluids is liquid.

9. The stack of claim 8 wherein both of said fluids are liquid and further comprising:

means for receiving the liquid heated by said stack, removing at least a portion of the heat therefrom, and recirculating the heated fluid to said stack.

10. The stack of claim 9 wherein said heat removing means comprises a heat exchanger for dissipating said heat to ambient atmosphere.

11. In a beverage cooler of the type including a reservoir for the beverage to be cooled, refrigeration means through which the beverage is circulated, means for circulating a heat removing fluid through the refrigeration means, and means for removing heat from said fluid, the improvement wherein said refrigeration means comprises:

a plurality of thermoelectric modules, each having a relatively coolable surface and a relatively heatable surface interconnected by thermoelectric junction forming means, said modules being arranged such that the heatable surfaces of adjacent modules face each other and the coolable surfaces of adjacent modules face each other;

means for electrically energizing said thermoelectric junctions to activate said surfaces to their hot and cold relative temperatures;

a plurality of spacers, each spacer being positioned between, and sealed against, either of two facing hot surfaces or two facing cold surfaces, each of said spacers defining a fluid flow passage further defined by said facing surfaces;

means for passing said beverage through those passages of said spacers further defined by said facing cold surfaces; and means for passing said heat removing fluid through those passages of said spacers further defined by said facing hot surfaces.

12. The improvement of claim 11 wherein each of said spacers includes baffles to define its fluid flow passage in serpentine form.

13. The improvement of claim 12 wherein each of said spacers is elastomeric and in intimate sealing engagement with its respective facing surfaces.

14. The improvement of claim 13 wherein the beverage passing means comprises a beverage inlet manifold connected to supply beverage to the spacer passages and a beverage outlet manifold connected to receive beverage from said spacer passages.

15. The improvement of claim 14 wherein the heat removing fluid passing means comprises a coolant inlet manifold connected to supply heat removing fluid to the spacer passages and a coolant outlet manifold connected to receive heat removing fluid from said spacer passages.

16. The method of transferring heat from a first fluid to a second fluid using a plurality of thermoelectric modules, each of said modules having, during operation, a relatively cold heat transfer surface and a relatively hot heat transfer surface which comprises:

aligning said modules in a stack with adjacent modules having their hot surfaces separated and facing one another and their cold surfaces separated and facing one another;

passing said first fluid between the separated cold surfaces to transfer heat from said first fluid to said cold surfaces; and passing said second fluid between the separated hot surfaces to transfer heat from said hot surfaces to said second fluid.

17. The method of claim 16 wherein at least one of said fluids is a liquid.

18. The method of claim 16 comprising constraining at least one of said fluids within a serpentine path bounded by said heat transfer surfaces.

19. The method of claim 18 wherein at least one of said fluids is a liquid.

20. The method of claim 16 comprising the further step of removing heat from said second fluid and returning it to said stack.

* * * * *